US005263810A

United States Patent [19]

Takekata et al.

[11] Patent Number: 5,263,810

[45] Date of Patent: Nov. 23, 1993

[54] WORKING IMPLEMENT CONNECTION STRUCTURE FOR A WORKING VEHICLE HAVING A BOOM ASSEMBLY

[75] Inventors: Mitsuhiro Takekata; Kentaro Nakamura, both of Sakai, Japan

[73] Assignee: Kubota Corporation, Osaka, Japan

[21] Appl. No.: 820,179

[22] Filed: Jan. 13, 1992

[30] Foreign Application Priority Data

Jan. 16, 1991 [JP] Japan ..... 3-003428

[51] Int. Cl.[5] ..... E02F 9/00

[52] U.S. Cl. ..... 414/723; 403/322; 403/327

[58] Field of Search ..... 414/723; 403/322, 325, 403/327; 292/302, 332, 333, 335, 60, 163, 175; 172/272-275; 37/118 R, 118 A, 103

[56] References Cited

U.S. PATENT DOCUMENTS

| | | | |
|---|---|---|---|
| 1,570,135 | 1/1926 | Emmert | 292/335 |
| 1,858,345 | 5/1932 | Spindler | 292/335 |
| 2,963,183 | 12/1960 | Przybylski | 414/723 |
| 3,985,249 | 10/1976 | Aker et al. | 414/723 |
| 4,846,624 | 7/1989 | Hohn | 414/723 |
| 4,984,958 | 1/1991 | Kaczmarczyk . | |
| 4,986,722 | 1/1991 | Kaczmarczyk et al. . | |
| 4,997,218 | 3/1991 | Culling | 292/60 |

FOREIGN PATENT DOCUMENTS

| | | | |
|---|---|---|---|
| 2513772 | 10/1975 | Fed. Rep. of Germany | 414/723 |

*Primary Examiner*—Michael S. Huppert
*Assistant Examiner*—Donald W. Underwood
*Attorney, Agent, or Firm*—Jordan and Hamburg

[57] ABSTRACT

A connection structure for connecting a loader bucket, through a mounting bracket pivotable by extension and contraction of a cylinder, to a forward end of a boom assembly vertically movably attached to a working vehicle. The mounting bracket includes a pivot element and an engaging member. The mounting bracket is pivoted by the cylinder with the pivot element anchored to a hook provided on the bucket, to engage the engaging member with an engageable member provided on the bucket. Upon completion of this engagement, a lock mechanism is operable to cause a locking pin to extend through and latch the engaging member and engageable member.

2 Claims, 8 Drawing Sheets

WORKING IMPLEMENT CONNECTION STRUCTURE FOR A WORKING VEHICLE HAVING A BOOM ASSEMBLY

BACKGROUND OF THE INVENTION

1. Field of the Invention

The present invention relates to a connection structure for use on a working vehicle having a boom assembly and an implement actuating cylinder, for connecting a working implement such as a bucket loader to the boom assembly.

2. Description of the Related Art

This type of connection structure is known from U.S. Pat. Nos. 4,986,722 and 4,984,958, for example. This connection structure includes, on the one hand, first and second engaging members provided at upper and lower positions, respectively, of a carrier interconnecting booms and an implement actuating cylinder and, on the other hand, first and second engageable members provided on a mounting bracket secured to a loader bucket for engagement with the first and second engaging members. When connecting the loader bucket to the boom assembly, the first engaging member is engaged with the first engageable member, and then the implement actuating cylinder is operated to engage the second engaging member with the second engageable member. Further, the mounting bracket includes a latch mechanism for locking the second engaging member to the second engageable member. The latch mechanism is operable when a projection provided on the boom assembly contacts a trigger element of the latch mechanism. For this purpose, after the first and second engaging members are engaged with the first and second engageable members, respectively, the implement actuating cylinder is further operated to move the boom assembly toward the mounting bracket in order to operate the latch mechanism.

The above implement connection structure has a disadvantage that, when the first and second engaging members have been engaged with the first and second engageable members, their engagement is not locked yet, i.e. the latch mechanism remains inoperative. The implement actuating cylinder must be further operated to operate the latch mechanism.

SUMMARY OF THE INVENTION

The object of the present invention is to provide a connection structure for use on a working vehicle having a boom assembly and an implement actuating cylinder, in which a mechanism for locking components of a boom assembly and those of a working implement together is operable upon completion of engagement between these components when connecting the working implement such as a loader bucket to the boom assembly.

The above object is fulfilled, according to the present invention by a connection structure comprising a mounting bracket connected to a boom assembly and an implement actuating cylinder and including first and second engaging devices; a working implement including first and second engageable devices for engagement with the engaging devices, respectively; a lock pin movable between a lock position for locking the second engaging device and second engageable device to an engaged state, and an unlock position for unlocking the second engaging device and second engageable device from the engaged state; and a lock pin releasing device for acting on the lock pin substantially in a position of engagement between the second engaging device and second engageable device, which is achieved by pivotal movement of the mounting bracket with the first engaging device engaging the first engageable device, to move the lock pin from the unlock position to the lock position.

The connection structure according to the present invention functions as follows. The first engaging device on the mounting bracket is engaged with the first engageable device on the working implement, and then the cylinder is contracted. As a result, the working implement and mounting bracket pivot about the first engaging device, and the second engaging device on the mounting bracket approaches the second engageable device on the working implement. When the second engaging device engages the second engageable device, the lock pin releasing device acts on the lock pin to move the lock pin to a position to lock the engagement between the second engaging device and second engageable device. This achieves a reliable connection between the mounting bracket and working implement. This connection may be canceled simply by manually or otherwise moving the lock pin to the unlock position and operating the cylinder reversely to the connecting operation.

Other features and advantages of the present invention will be apparent from the following description of the preferred embodiment to be had with reference to the drawings.

DETAILED DESCRIPTION OF THE PREFERRED EMBODIMENT

Figure 1:
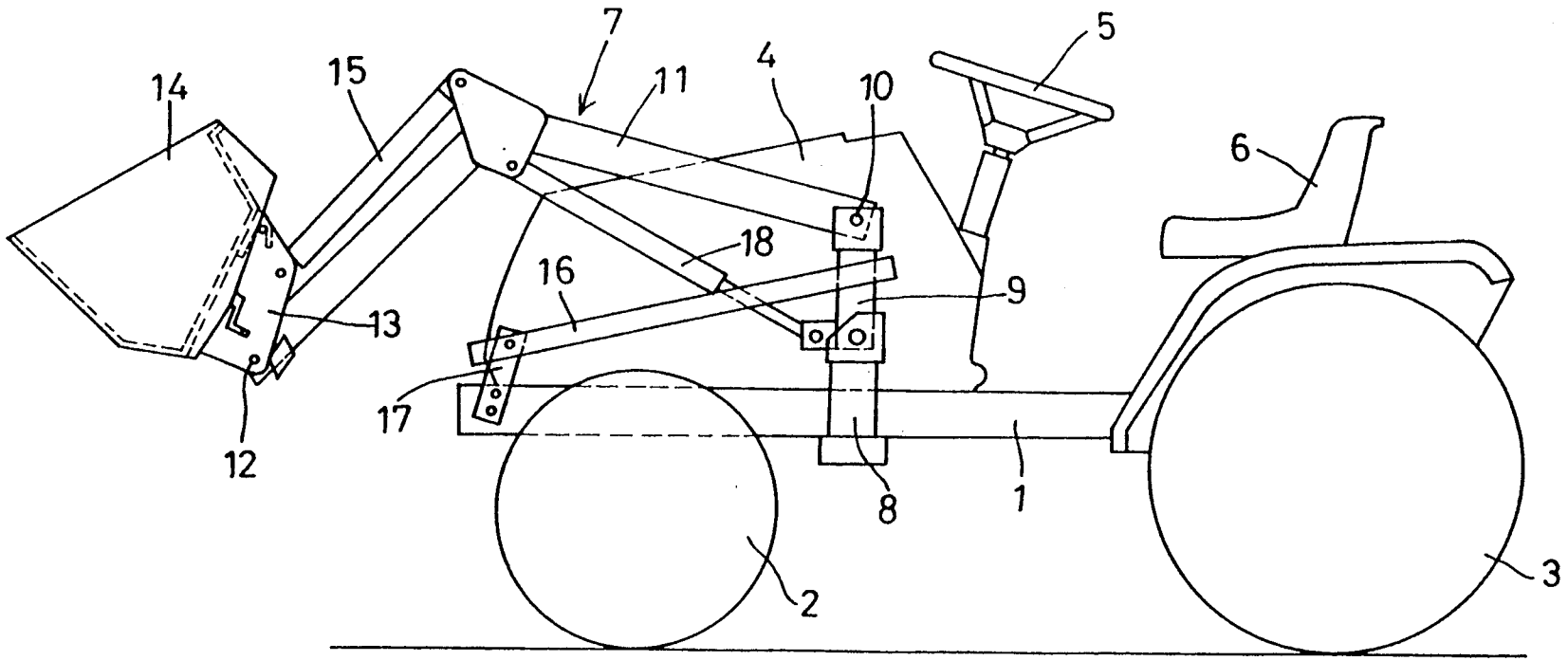
FIG. 1 is a side view of a tractor employing a connection structure according to the present invention for connecting a working implement which is in the illustrated example a loader bucket.
Figure 2:
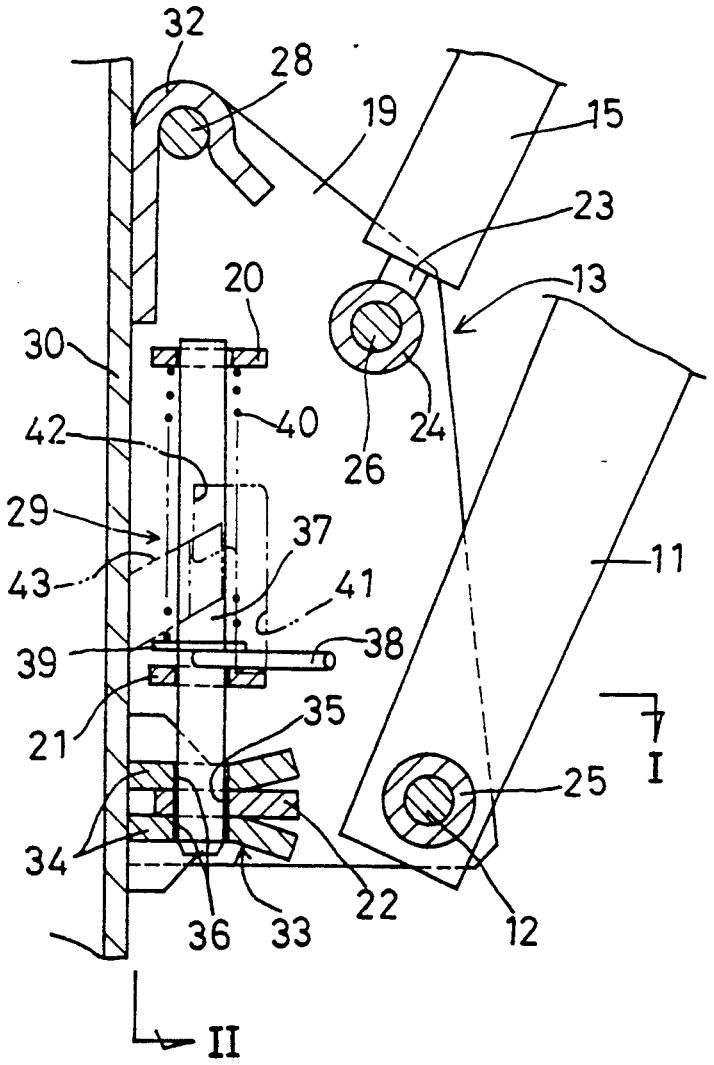
FIG. 2 is a sectional side view of a mounting bracket of the connection structure taken on line III of FIG. 3.
Figure 3:
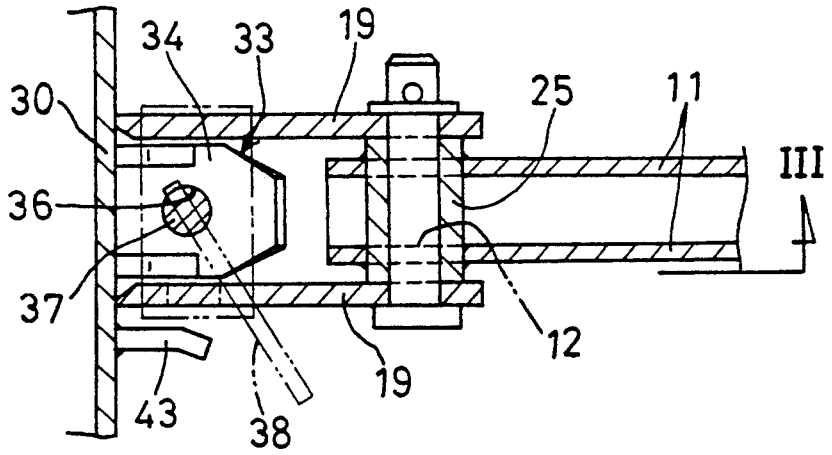
FIG. 3 is a cross section taken on line I of FIG. 2.
Figure 4:
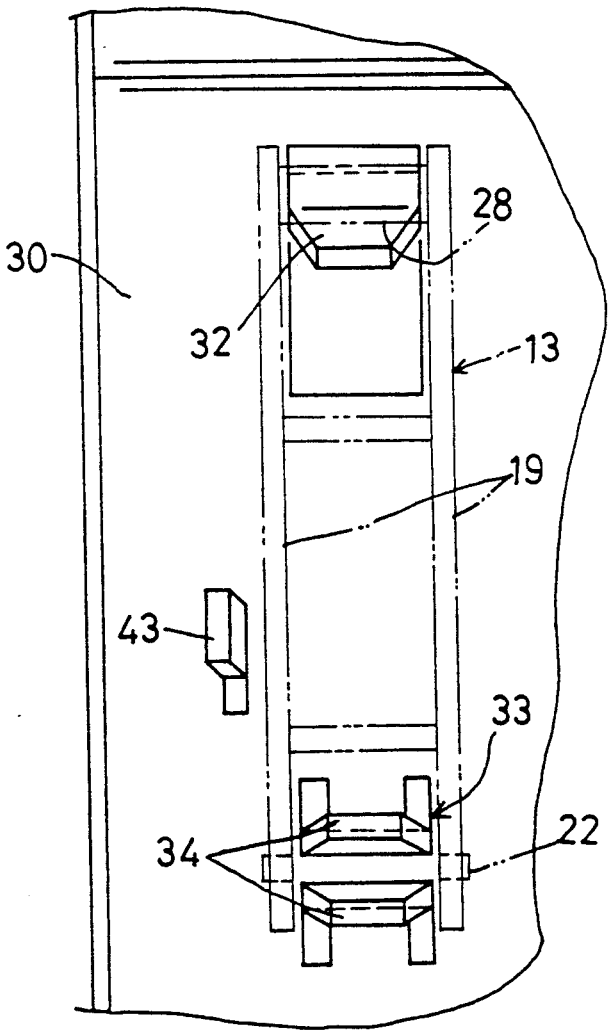
FIG. 4 is a rear view of the loader bucket showing components of the connection structure provided on the bucket.
Figure 5:
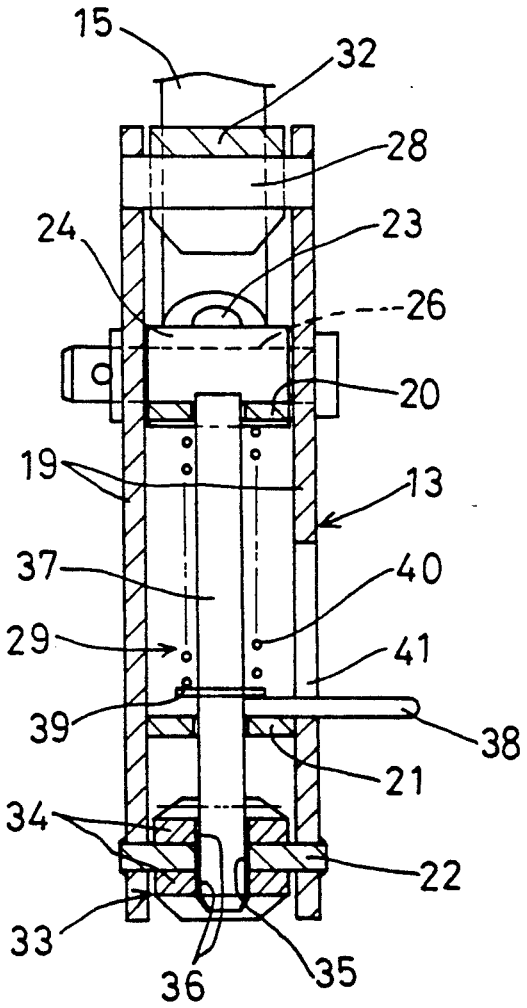
FIG. 5 is a section taken on line II of FIG. 2.

FIG. 1 shows a tractor having a front loader attached thereto through a connection structure according to the present invention.

The illustrated tractor comprises a tractor body 1, front wheels 2, rear wheels 3, a hood 4, a steering wheel 5 and a driver's seat 6. The front loader 7 includes a pair of right and left masts 9 erected on a mounting frame 8 fixed to the tractor body 1, a pair of right and left booms 11 vertically movably connected through a pivot 10 to upper ends of the right and left masts 9, a mounting bracket 13 pivotally connected through a cross shaft 12 to forward ends of the booms 11, a loader bucket 14 which is one example of a working implement removably attached to the booms 11 through the mounting bracket 13, and a bucket cylinder 15 for pivoting the mounting bracket 13.

The masts 9 are also connected through braces 16 to brackets 17 at front ends of the tractor body 1. The booms 11 are vertically movable about the pivot 10 by a boom cylinder 18 extending between the booms 11 and a lower position of the masts 9.

As shown in FIGS. 2 through 5, the mounting bracket 13 includes a pair of right and left bracket plates 19 rigidly interconnected through connecting plates 20, 21 and 22. The connecting plate 22 acts as an engaging device between the mounting bracket 13 and loader bucket 14 as will be described in detail later. The mounting bracket 13 is pivotally connected at an upper rearward position thereof through a cross shaft 26 to a boss 24 at a forward end of a piston rod 23 of the cylinder 15. Further, the mounting bracket 13 is pivotally connected at a lower position thereof through the cross shaft 12 to a boss 25 at the forward ends of the booms 11.

The mounting bracket 13 further includes a rod-like pivot element 28 formed at an upper front position thereof to act as a first engaging device, and a lock mechanism 29 provided below the pivot element 28. The pivot element 28 comprises a pin extending between the two bracket plates 19. This pivot element 28 is movable, from below, into relatively swingable engagement with a hook 32 having an inverted J-shape and attached to a rear wall of a back plate 30 of the bucket 14. The hook 32 defines an inside surface fitting on the pivot element 28, and acts as a first engageable device.

Figure 6A:
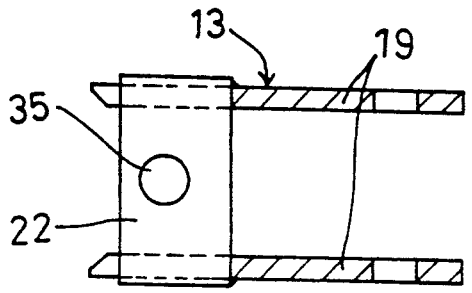
FIG. 6*a* is a cross section showing a connecting plate in the mounting bracket.

The lock mechanism 29 includes a lock pin 37 for latching the connecting plate 22 to a socket 33 projecting from the back plate 30 of the bucket 14 to act as a second engageable device. Thus, when the mounting bracket 13 is turned in a direction to stand upright by contracting the cylinder 15 with the pivot element 28 engaging the hook 32, the bucket 14 and mounting bracket 13 are locked together to be inseparable. The projecting socket 33 includes two projecting plates 34 fixed to the back plate 30 of the bucket 14 and vertically spaced apart for receiving the connecting plate 22 therebetween. As seen from FIG. 3, the projecting plates 34 have a suitable width for insertion between the pair of bracket plates 19. As shown in FIG. 6*a*, the connecting plate 22 defines a pinhole 35. The projecting plates 34 also define pinholes 36 for alignment with the pinhole 35 and penetration by the lock pin 37. Upper parts of the lock pin 37 are vertically slidably inserted through pinholes defined in the connecting plates 20 and 21. The lock pin 37 carries a handle 38 attached to an intermediate position and extending perpendicular thereto. The lock pin 37 further carries a coil spring 40 mounted between the connecting plate 20 and a spring bearing 39 on the handle 38 for urging the lock pin 27 downwardly to a lock position.

Figure 6B:
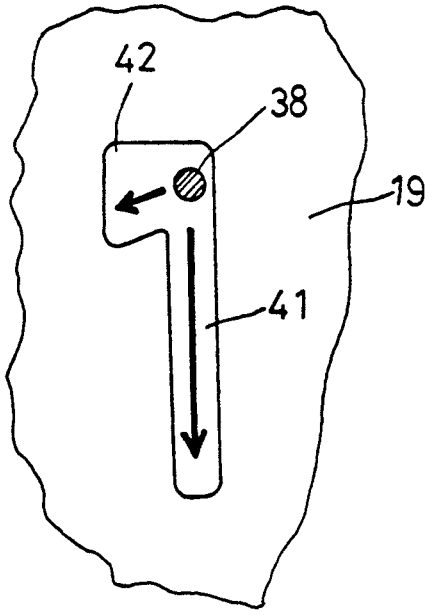
FIG. 6*b* is a view showing a guide slot and cutout defined in the mounting bracket.

The handle 38 is vertically slidably inserted into a vertically elongate guide slot 41 defined in one of the bracket plates 19. As shown in FIG. 6*b*, this bracket plate 19 also defines a cutout 42 extending sideways from an upper end of the guide slot 41. The cutout 42 acts as a lock pin retainer for retaining the handle 38 to hold the lock pin 37 in a position retracted from the pinholes 35 and 36. On the other hand, a release plate 43 is fixed to the back plate 30 of the bucket 14 to act as a lock pin releasing device for pushing the handle 38 out of the cutout 42 when the connecting plate 22 is fitted between the projecting plates 34. The handle 38 may be gripped outside the bracket plate 19, and may be hooked on top of the release plate 43.

Figure 7:
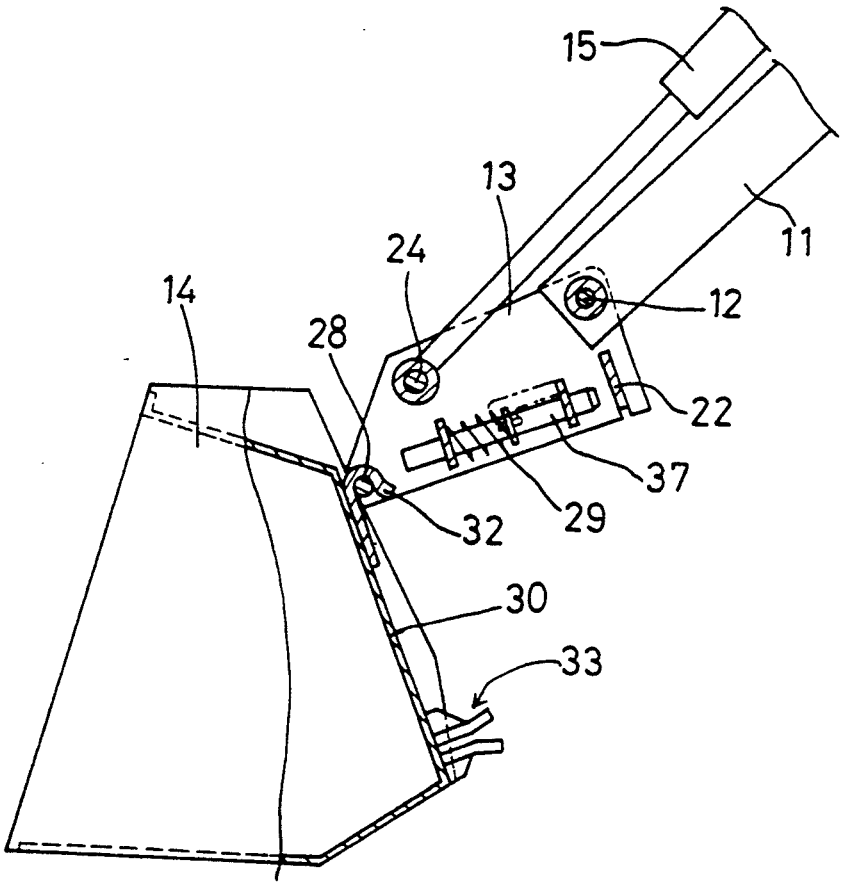
FIG. 7 is a sectional view showing a starting position of a bucket connecting operation.

Bucket connecting and disconnecting operations will be described next. For connecting the bucket 14, the handle 38 of the lock mechanism 29 is first raised against the force of the spring 40 and placed into the cutout 42 at the upper end of the guide slot 41 to set the lock pin 37 to an unlock position. Next, the cylinder 15 is fully extended to swing the mounting bracket 13 counterclockwise about the cross shaft 12 to a substantially horizontal posture. In this state, the pivot element 28 of the mounting bracket 13 projects forwardly. The booms 11 are lowered and then the pivot element 28 is moved into engagement with the hook 32 of the bucket 14 as shown in FIG. 7.

Figure 8A:
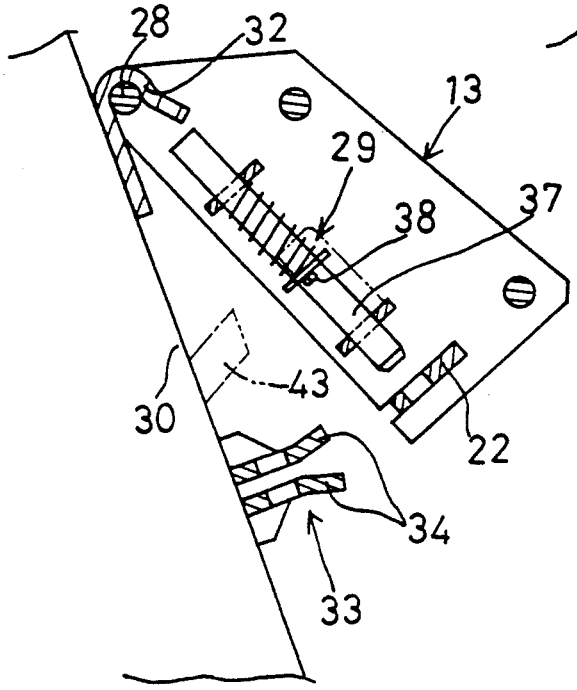
FIGS. 8*a* through 8*d* are sectional views showing different stages of the bucket connecting operation.
Figure 8B:
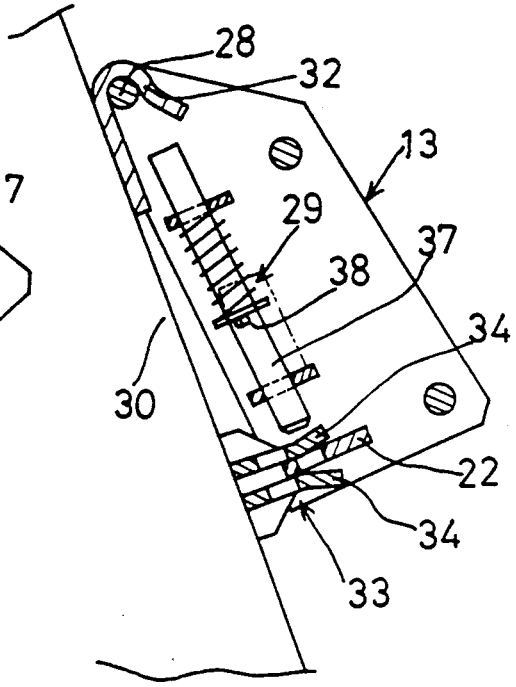
Figure 8C:
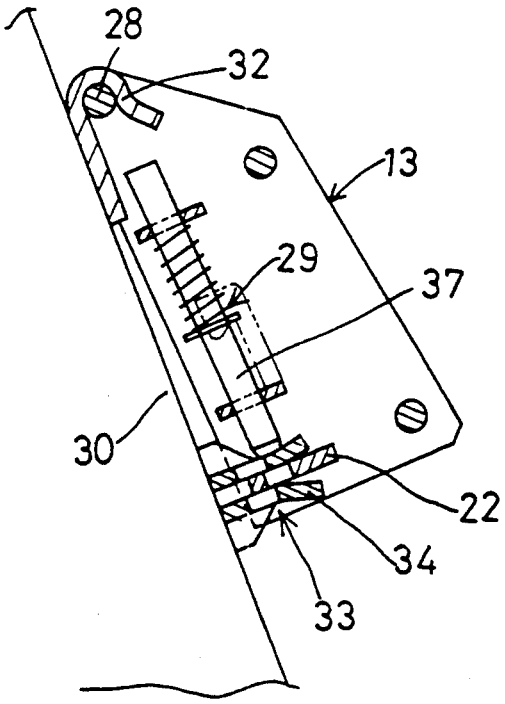
Figure 8D:
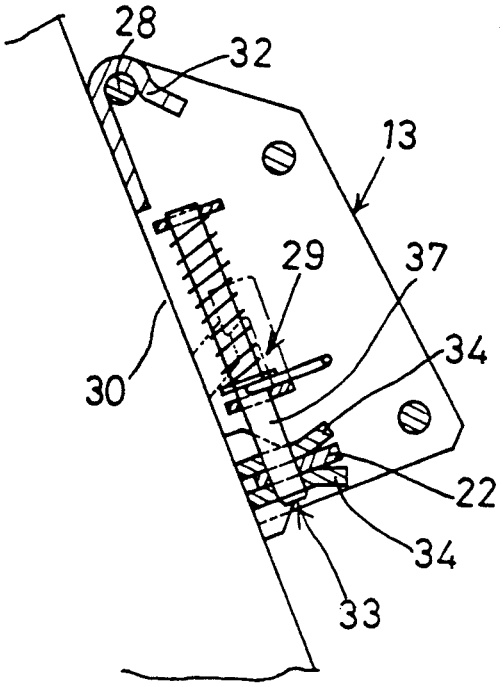

Next, the cylinder 15 is contracted to swing the mounting bracket 13 in the upstanding direction (clockwise) about the cross shaft 12. When the connecting plate 22 enters the projecting socket 33, the release plate 43 contacts the handle 38 of the lock pin 37 to release the lock pin 37 downwardly. As a result, the lock pin 37 extends through the pinholes 35 and 36 of the connecting plate 22 and projecting socket 33, whereby the lock mechanism 29 locks the bucket 14 and mounting bracket 13 together. To describe this operation more specifically, when the mounting bracket 13 pivots about the cross shaft 12, the mounting bracket 13 and bucket 14 make a relative pivotal movement toward each other about the pivot element 28 since this pivot element 28 is caught in the hook 32 of the bucket 14. After the projecting socket 33 and connecting plate 22 approach each other as shown in FIG. 8*a*, the operation proceeds through the stages shown in FIGS. 8*b* and 8*c* to the stage shown in FIG. 8*d* in which the connecting plate 22 is fitted between the upper and lower projecting plates 34 of the projecting socket 33. In the stage shown in FIG. 8*b*, the release plate 43 contacts and pushes the handle 38, whereby the lock pin 37 is removed from the cutout 43 and lowered by the spring 40 toward the lock position to be stopped by the projecting socket 33. When the connecting plate 22 is moved fully into the projecting socket 33, the lock pin 38 is aligned to and moved into the pinholes 35 and 36, thereby locking the projecting socket 33.

Thus, the bucket 14 is inseparably connected to the mounting bracket 13 through the pivot element 28 and lock mechanism 29, which completes connection of the bucket 14 to the booms 11. As described above, the mounting bracket 13 is swung to the upstanding posture after the pivot element 28 is anchored to the hook 32 of the bucket 14, and the lock mechanism 29 is operable upon completion of engagement between the mounting bracket 13 and bucket 14. These features provide for a safe and reliable bucket connecting operation.

Figure 9A:
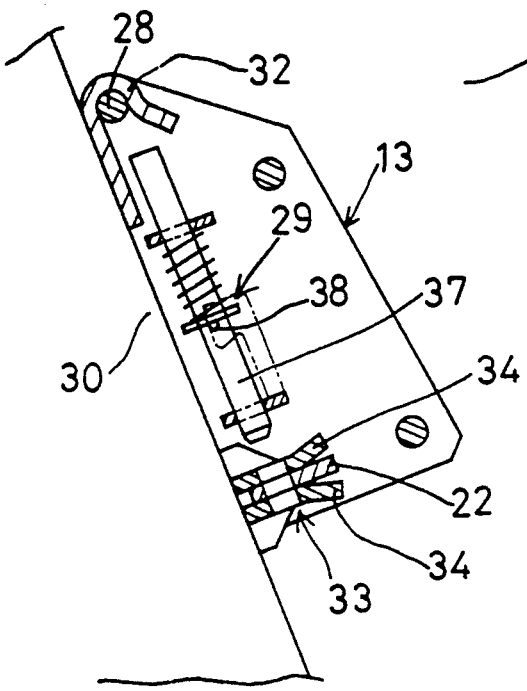
FIGS. 9*a* through 9*c* are sectional views showing different stages of a bucket disconnecting operation.
Figure 9B:
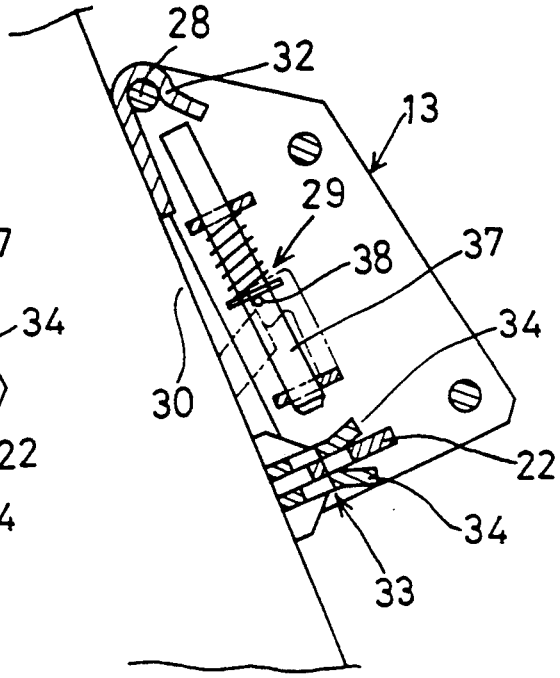
Figure 9C:
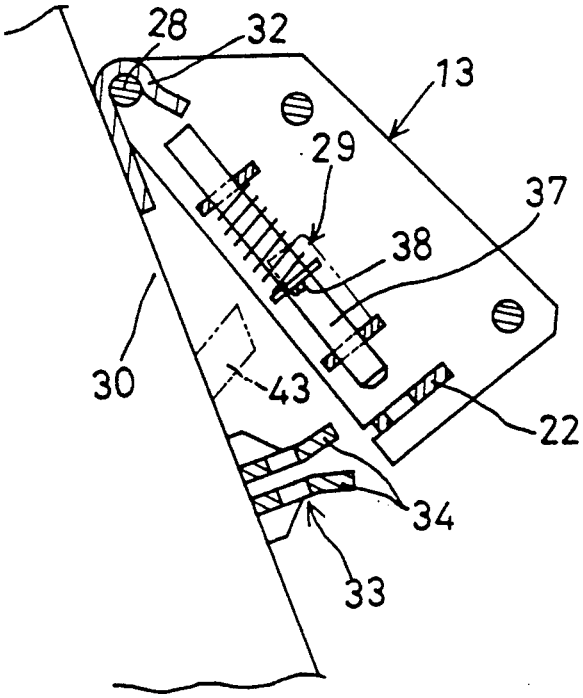

For disconnecting the bucket 14, the lock pin 37 is raised by the handle 38 against the spring 40, and the handle 38 is moved onto the release plate 43 to undo the lock as shown in FIG. 9*a*. After the bucket 14 is placed on the ground, the mounting bracket 13 is swung about the pivot element 28 relative to the bucket 14 as shown in FIG. 9*b*, to remove the connecting plate 22 from the projecting socket 33. When the connecting plate 22 is completely separated from the projecting socket 33 as shown in FIG. 9*c*, the booms 11 may be lowered to disengage the pivot element 28 from the hook 32. The lock pin 37 remains in the raised position, which allows the driver to connect a different working implement without alighting from the tractor.

The pivot element 28 of the mounting bracket 13 may be U-shaped for engaging a pin-like element on the bucket 14. The working implement is not limited to the loader bucket 14, but may be a fork or other implement. It is not absolutely necessary to swing the mounting bracket 13 prior to connection or disconnection of the working implement, but the booms 11 may only be raised or lowered as long as the working implement is in a pivotable state.

What is claimed is:

1. A connection structure for use on a working vehicle having a boom assembly and an implement actuating cylinder, for connecting a working implement to the boom assembly, said connection structure comprising:

mounting bracket means including a first cross shaft rotatably connected to said cylinder, a second cross shaft rotatably connected to said boom assembly, first engaging means disposed in an upper region of said mounting bracket means, and a second engaging means disposed in a lower region of said mounting bracket means;

first engageable means disposed in a region of said working implement opposed to said mounting bracket means for pivotal engagement with said first engaging means;

second engageable means disposed in a region of said working implement opposed to said mounting bracket means to be engageable with said second engaging means by pivotal movement of said mounting bracket means with said first engaging means and said first engageable means placed in engagement, said second engaging means and second engageable means having apertures that are aligned when said second engageable means is engaged with said second engaging means;

lock means including a lock pin, said lock pin being mounted to be movable between a lock position in which it extends through said apertures of said second engaging means and said second engageable means, and an unlock position in which it is free from at least one of said apertures of said second engaging means and said second engageable means; and lock pin release means positioned to engage said lock pin when said apertures of said second engaging means and said second engageable means are substantially in alignment to move said lock pin from said unlock position to said lock position, said lock means being provided on said mounting bracket means and said lock pin release means is provided on said working element, said lock means including urging means for urging said lock pin to said lock position, and a retainer for retaining said lock pin in said unlock position against an urging force of said urging means, said lock pin release means being operable to move said lock pin off said retainer.

2. A connection structure for use on a working vehicle having a boom assembly and an implement actuating cylinder, for connecting a working implement to the boom assembly, said connection structure comprising:

mounting bracket means including a first cross shaft rotatably connected to said cylinder, a second cross shaft rotatably connected to said boom assembly, first engaging means disposed in an upper region of said mounting bracket means, and a second engaging means disposed in a lower region of said mounting bracket means;

first engageable means disposed in a region of said working implement opposed to said mounting bracket means for pivotal engagement with said first engaging means;

second engageable means disposed in a region of said working implement opposed to said mounting bracket means to be engageable with said second engaging means by pivotal movement of said mounting bracket means with said first engaging means and said first engageable means placed in engagement;

lock means mounted on said mounting bracket means and including a lock pin, said lock pin being mounted to be movable between a lock position in which it engages said second engaging means and said second engageable means, and an unlock position in which it is disengages from at least one of said second engaging means and said second engageable means; and lock pin release means positioned on said working element and positioned to engage said lock pin when said second engaging means engages said second engageable means to move said lock pin from said unlock position to said lock position, said mounting bracket means including two parallel bracket plates attached to respective booms of said boom assembly, and at least two connecting plates for interconnecting said bracket plates, said connecting plates defining bores penetrable by said lock pin, one of said connecting plates acting as said second engaging means for engaging said second engageable means.

* * * * *